US011014351B2

(12) United States Patent
Stoeckle

(10) Patent No.: US 11,014,351 B2
(45) Date of Patent: May 25, 2021

(54) METHOD FOR IMPROVING THE DROPLET POSITIONING OF AN INKJET PRINTING DEVICE

(71) Applicant: Océ Holding B.V., Venlo (NL)

(72) Inventor: Ulrich Stoeckle, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/453,227

(22) Filed: Jun. 26, 2019

(65) Prior Publication Data

US 2019/0389205 A1 Dec. 26, 2019

(30) Foreign Application Priority Data

Jun. 26, 2018 (DE) ..... 10 2018 115296.5

(51) Int. Cl.
*B41J 2/045* (2006.01)

(52) U.S. Cl.
CPC ..... *B41J 2/04573* (2013.01); *B41J 2/04586* (2013.01)

(58) Field of Classification Search
CPC ..... B41J 2/04573; B41J 2/04586
See application file for complete search history.

(56) References Cited

U.S. PATENT DOCUMENTS

| | | | | |
|---|---|---|---|---|
| 9,944,070 | B1 | 4/2018 | Howkins et al. | |
| 2002/0135638 | A1 | 9/2002 | Okuda | |
| 2006/0071957 | A1* | 4/2006 | Shang | B41J 2/12 347/6 |
| 2007/0070109 | A1* | 3/2007 | White | B41J 29/393 347/19 |
| 2010/0060684 | A1 | 3/2010 | Barss et al. | |

OTHER PUBLICATIONS

German Search Report dated Mar. 12, 2019 for German application No. 10 2018 115 296.5.

* cited by examiner

*Primary Examiner* — Thinh H Nguyen
(74) *Attorney, Agent, or Firm* — Schiff Hardin LLP

(57) ABSTRACT

The droplet velocities of the nozzles of different groups of nozzles of a print head of an inkjet printing device are determined for different line clock rates. An optimized operating line clock rate is then determined for the operation of the printing device, where the deviation between the droplet velocities of the nozzles of the different groups is reduced (e.g. minimized). The droplet positioning along the transport direction of a recording medium may be advantageously homogenized via the convergence of the droplet velocities.

16 Claims, 3 Drawing Sheets

METHOD FOR IMPROVING THE DROPLET POSITIONING OF AN INKJET PRINTING DEVICE

CROSS REFERENCE TO RELATED APPLICATIONS

This patent application claims priority to German Patent Application No. 102018115296.5, filed Jun. 26, 2018, which is incorporated herein by reference in its entirety.

BACKGROUND

Field

The disclosure relates to an inkjet printing device. In particular, the disclosure relates to a method with which the precision of the positioning of ink droplets may be increased.

Related Art

Inkjet printing devices may be used for printing to recording media (such as paper, for example). For this, most often a plurality of nozzles are used in order to fire ink droplets onto the recording medium, and thus to generate a desired print image on the recording medium.

The different nozzles of an inkjet printing device may exhibit differences in the positioning of ink droplets on a recording medium, in particular along the transport direction of a recording medium. Such fluctuations in the droplet positioning may lead to a degradation of the print quality. In particular, line blurs in print images may be caused by such fluctuations. US Patent Application Publication No. 2010/0060684A1 describes a method for increasing the quality of ink droplets that are composed of multiple sub-droplets. U.S. Pat. No. 9,944,070B1 and US Patent Application Publication No. 2002/0135638A1 describe methods for determining the maximum activation frequency of a nozzle.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1*a* illustrates a block diagram of an inkjet printing device according to an exemplary embodiment of the present disclosure.

FIG. 1*b* illustrates an example route of an ink droplet between nozzle and recording medium according to an exemplary embodiment of the present disclosure.

FIG. 1*c* illustrates a nozzle plate of a print head according to an exemplary embodiment of the present disclosure.

FIG. 2*a* illustrates example lines of a print image given randomly selected activation frequency, or given a randomly selected line clock rate, according to an exemplary embodiment of the present disclosure.

FIG. 2*b* illustrates example lines of a print image given use of an optimized operating line clock rate via which fluctuations of the droplet velocity are reduced according to an exemplary embodiment of the present disclosure.

Figure 1A:
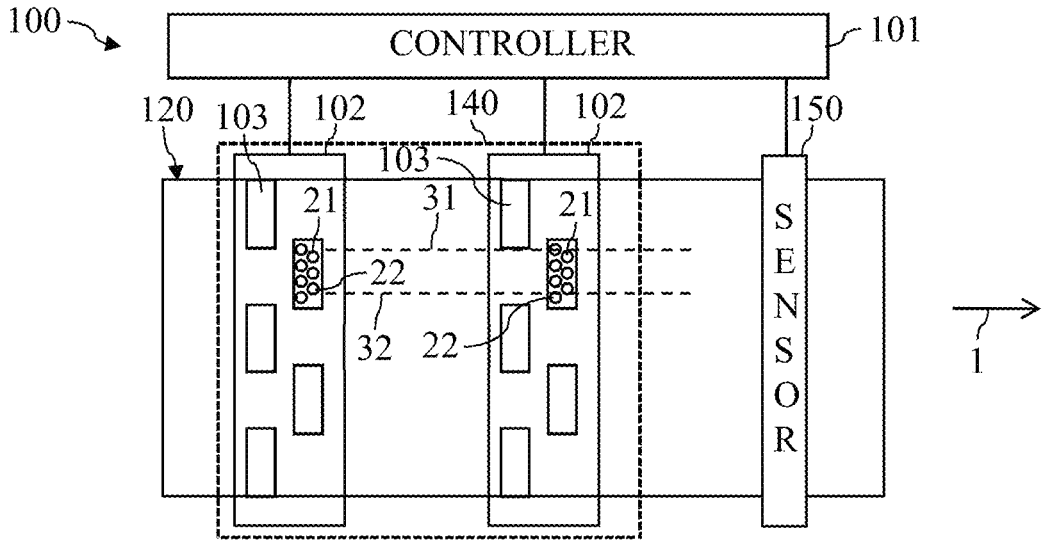

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to reduce fluctuations in the droplet positioning of different nozzles of an inkjet printing device to increase the print quality of the inkjet printing device.

In a method for improving the positioning of ink droplets of an inkjet printing device having a plurality of nozzles for printing to a recording medium according to an exemplary embodiment of the present disclosure, velocity data for different subsets of the plurality of nozzles are provisioned and/or determined. In an exemplary embodiment, the velocity data of a subset of nozzles thereby respectively indicate a droplet velocity of ink droplets that have been ejected by the one or more nozzles of the subset, for different line clock rates for the operation of the inkjet printing device. In an exemplary embodiment, the method includes the determination of an (e.g. optimized) operating clock rate for the operation of the inkjet printing device based on the velocity data. In an exemplary embodiment, the uniformity of the droplet velocities of the different subsets of nozzles may be increased via the operation with the (optimized) operating clock rate, and thus the positioning of the ink droplets may be improved and/or made more uniform.

In an aspect of the disclosure, an inkjet printing device is described for printing to a recording medium. In an exemplary embodiment, the inkjet printing device includes a plurality of nozzles respectively having at least one actuator. In an exemplary embodiment, the actuators of the plurality of nozzles are respectively activated according to an operating line clock rate to eject ink droplets in order to print image dots of a print image onto a recording medium. In an exemplary embodiment, the printing device includes a controller that is configured to activate the plurality of nozzles repeatedly according to the operating line clock rate in order to repeatedly print different image dots of the print image onto the recording medium. In an exemplary embodiment, the operating line clock rate depends on velocity data for different subsets of the plurality of nozzles. For different line clock rates, the velocity data of a subset of nozzles thereby indicate a respective droplet velocity of ink droplets that have been ejected by the one or more nozzles of the subset. In particular, the operating line clock rate may be such that a relatively high uniformity of the droplet velocities of the different subsets of nozzles is produced by the operating line clock rate, such that the positioning of the ink droplets is improved and/or made more uniform.

FIG. 1*a* illustrates a printing device (e.g. printer) 100 according to an exemplary embodiment of the present disclosure. In an exemplary embodiment, the printing device 100 depicted in FIG. 1*a* is designed for printing to a recording medium 120 in the form of a sheet or page or plate or band. The recording medium 120 may be produced from paper, paperboard, cardboard, metal, plastic, textiles, a combination thereof, and/or other materials that are suitable and can be printed to. The recording medium 120 is directed along the transport direction 1 (represented by an arrow) through the print group 140 of the printing device 100.

In an exemplary embodiment, the print group 140 of the printing device 100 includes two print bars 102. In an exemplary embodiment, each print bar 102 may be used for printing with ink of a defined color (for example black, cyan, magenta, and/or yellow, and possible magnetic ink character recognition code (MICR) ink). In an exemplary embodiment, the printing device 100 includes at least one fixer or dryer that is configured to fix a print image printed onto the recording medium 120.

In an exemplary embodiment, the print bar(s) 102 include one or more print heads that are arranged in parallel in multiple rows to print the dots of different columns 31, 32 of a print image onto the recording medium 120. In the example depicted in FIG. 1*a*, a print bar 102 includes five print heads 103, where each print head 103 prints the dots of a group of columns 31, 32 of a print image into the recording medium 120. The number of print bars and print heads are not limited.

In the exemplary embodiment depicted in FIG. 1*a*, each print head 103 of the print head 140 includes multiple nozzles 21, 22, wherein each nozzle 21, 22 is configured to fire or eject ink droplets toward (and on to) the recording medium 120. For example, a print head 103 of the print head may include multiple thousands of effectively utilized nozzles 21, 22 that are arranged along multiple rows transversal to the transport direction 1 of the recording medium 120. Dots of a line of a print image may be printed onto the recording medium 120 by the nozzles 21, 22 of a print head 103 of the print group 140, transversal to the transport direction 1 (i.e. along the width of the recording medium 120). In this example, the recording medium 120 is in the form of a web, but is not limited thereto.

In an exemplary embodiment, the printing device 100 also includes a controller 101 (e.g. a control hardware) that is configured to activate the actuators of the individual nozzles 21, 22 of the individual print heads 103 of the print group 140 to apply the print image onto the recording medium 120. In an exemplary embodiment, the controller 101 is configured to activate the actuators based on print data.

In an exemplary embodiment, the print group 140 of the printing device 100 includes at least one print group 102 having K nozzles 21, 22 that may be activated with a defined line clock rate, or with a defined activation frequency, to print a line that runs transversal to the transport direction 1 of the recording medium 120 onto the recording medium 120 with K pixels or K columns 31, 32 of a print image, for example with K>1000. In this example, the line clock rate indicates with what timing lines of a print image are printed onto a recording medium 120. The activation frequency thereby typically corresponds to the line clock rate, such that the nozzles 21, 22 of a print head 103 or print bar 102 are activated precisely once per line of a print image to be printed. In particular, the actuator of a nozzle 21, 22 may be activated for a line (with a defined waveform) in order to produce an ink ejection for a (non-white) dot in the line, or may be activated in order to produce no ink ejection (for a "white dot" in the line). In the depicted example, the nozzles 21, 22 are installed immobile or fixed in the printing device 100, and the recording medium 120 is directed past the stationary nozzles 21, 22 with a defined transport velocity. The line clock rate or the activation frequency may be modified accordingly via a modification of the transport velocity (given a constant dot resolution along the transport direction 1).

Figure 1B:
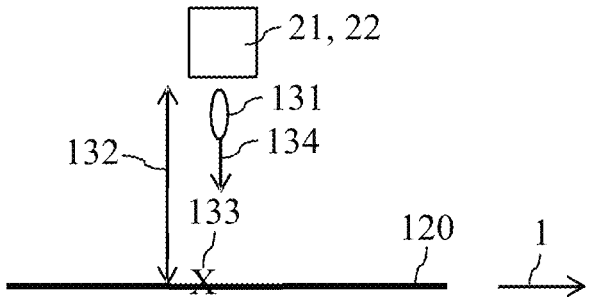

In an exemplary embodiment, the print quality of a print image depends on, among other things, the accuracy of the positioning of the individual ink droplets of the different nozzles 21, 22 of the inkjet printing device 100. In an exemplary embodiment, the accuracy of the positioning of an ink droplet thereby depends on the droplet velocity with which an ink droplet is fired from a nozzle 21, 22 toward a recording medium 120. This is depicted by way of example in FIG. 1*b*. In particular, FIG. 1*b* shows a nozzle 21, 22 via which an ink droplet is ejected with a defined droplet velocity 134. The droplet velocity 134 thereby depends on the deflection of an actuator of the nozzle 21, 22, for example. In particular, the droplet velocity 134 of an ink droplet 131 depends on the waveform with which the actuator of a nozzle 21, 22 is activated. The actuator of a nozzle 21, 22 is thereby typically activated with a defined activation frequency (meaning according to the line clock rate) in order to eject ink droplets 131.

On its way to the recording medium 120, the ink droplet 131 traverses the route 132, which is typically designated as a nip. At the same time, the recording medium 120 moves past the nozzle 21, 22 with a defined transport velocity along the transport direction 1. In an exemplary embodiment, as a result of this, the position 133 (along the transport direction 1) at which the ink droplet 131 strikes the recording medium 120 depends on the transport velocity of the recording medium 120 and on the droplet velocity 134 of the ink droplet 131.

The different nozzles 21, 22 of an inkjet printing device 100, and in particular of a print bar 102 or of a print head 103, may have droplet velocities of different magnitudes. In other words, the ink droplets may be fired from the different nozzles 21, 22 toward a recording medium 120 with different velocities 134. Such differences in the droplet velocities 134 may result from the design of a print head 103, for example. Inaccuracies in the positioning of dots of a print image may occur as a result of the different droplet velocities 134, whereby the print quality is negatively affected.

Figure 1C:
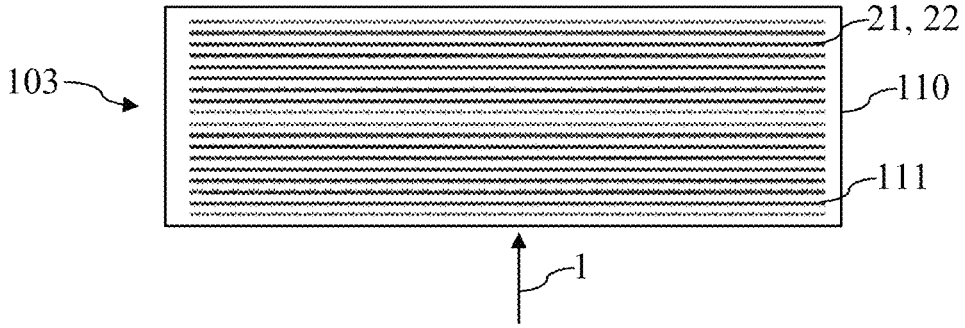

FIG. 1*c* shows an example of a nozzle plate 110 of a print head 103 at which the openings of the nozzles 21, 22 of the print head 103 are arranged in multiple rows 111. FIG. 1*c* moreover shows the transport direction 1 of the recording medium 120, which runs orthogonal to the path of the rows 111 of the nozzles 21, 22 of the print head 103. In an exemplary embodiment, a print head 103 may have, for example, 10, 20, 30, or more rows 111. A continuously printed line of a print image is typically printed by the nozzles 21, 22 of all rows 111 of a print head 103. In an exemplary embodiment, for this purpose, the nozzles 21, 22 of the different rows 111 are activated with a time offset, such as activated with a time offset by the line clock pulse or according to the activation frequency. At a first point in time, the nozzles 21, 22 of the first nozzle row 111 are activated in order to print dots of the line onto a recording medium 120. The recording medium 120 continues to move in the transport direction 1 up to a following second point in time, so that additional dots of the line may be printed onto the recording medium 120 by the nozzles 21, 22 of the second nozzle row 111 at the second point in time etc., until finally the last dots of the line may be printed onto the recording medium 120 by the $N^{th}$ nozzle row 111 (for example N=32) at an $N^{th}$ point in time.

Figure 2A:
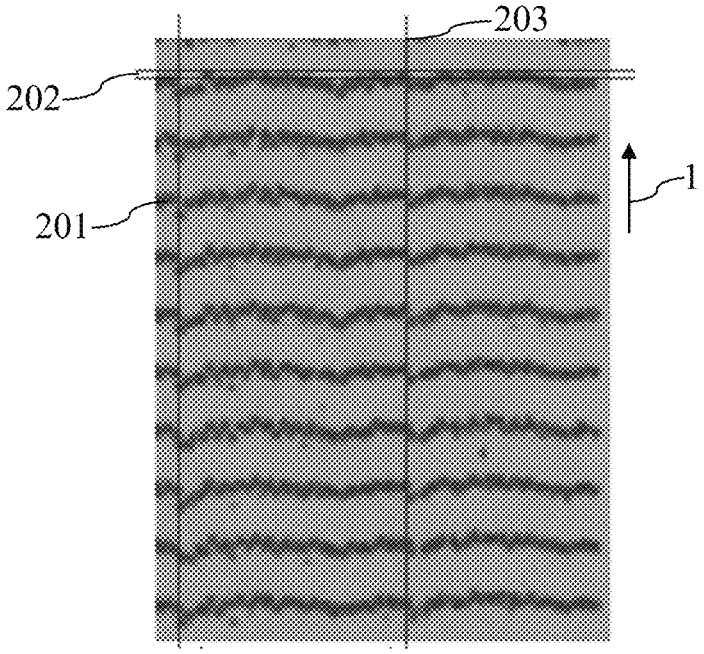

If the droplet velocities 134 of the nozzles 21, 22 of a print head 103, for example of the nozzles 21, 22 in different nozzle rows 111 of the print head 103, are different, fluctuations result in the positioning of the dots of a line of the print image. This is depicted by way of example in FIG. 2*a*. FIG. 2*a* shows the region 202 that is available for a line 201 on a recording medium 120 due to the dot resolution in the transport direction 1. Furthermore, FIG. 2*a* shows the actual positioning of the dots within a printed line 201. FIG. 2*a* also shows the boundaries 203 between directly adjacent print heads 103. From FIG. 2*a*, it is clear that the dot positions of the dots of a line 201 (orthogonal to the line 201, meaning along the transport direction 1) fluctuate relatively significantly, wherein the fluctuations of the dot positions are caused by different droplet velocities.

Inaccuracies in the dot positioning may be at least partially compensated for via the use of individual delays of the ink ejection of individual nozzles 21, 22. However, the magnitude of the possible delays is thereby limited by the chronological length of a line clock pulse. Alternatively or additionally, inaccuracies may be at least partially compensated for via image processing in order to provide print data for a print image that take into account the inaccuracies in the dot positioning. However, most often only relatively coarse deviation by one or more dots may be compensated for via the use of image processing.

A print head 103 typically has multiple groups or sub-groups of nozzles 21, 22, depending on design, wherein the nozzles 21, 22 within a group or sub-group have a relatively similar behavior with regard to the droplet velocity 134 and/or relatively small fluctuations with regard to the droplet velocity 134. On the other hand, the nozzles, 21, 22 from different groups or sub-groups exhibit a relative different behavior with regard to the droplet velocity 134 and/or relatively large fluctuations with regard to the droplet velocity 134. The different groups or sub-groups may comprise different rows 111 of a print head 103, or correspond to different rows 111 of a print head 103.

Figure 3:
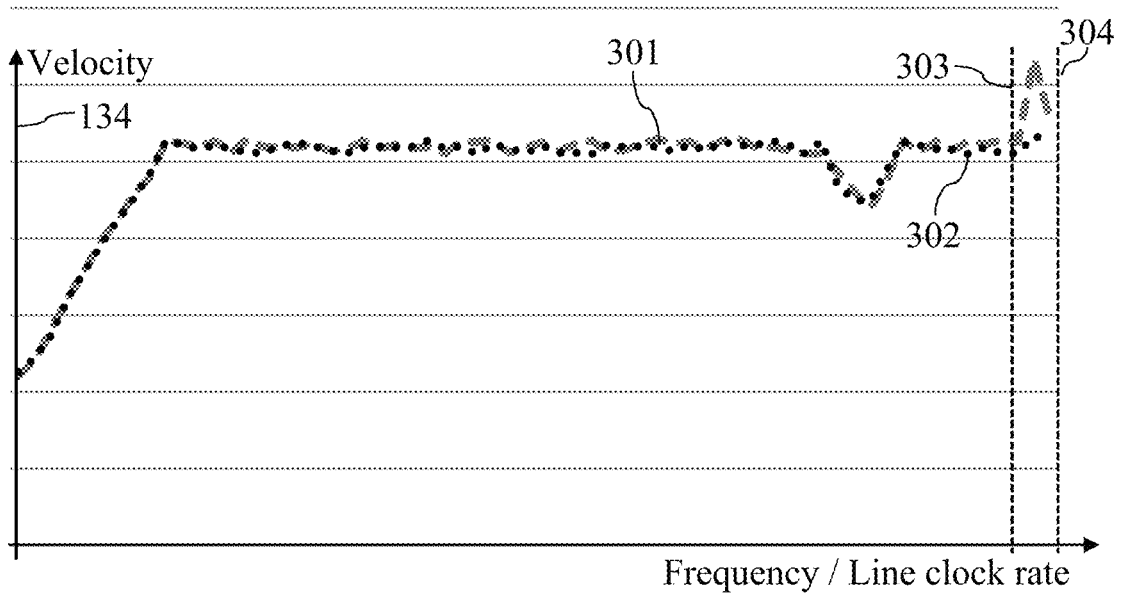
FIG. 3 illustrates example velocity data for different nozzle rows of a print head according to an exemplary embodiment of the present disclosure.

In an exemplary embodiment, velocity data for the different groups of nozzles 21, 22 is determined within the scope of a measurement of droplet velocities 134. The velocity data may thereby encompass the (average) droplet velocity 134 of the nozzles 21, 22 of a group as a function of the activation frequency or of the print speed of the nozzles 21, 22. FIG. 3 shows examples of velocity data for two different groups (in particular for two different rows 111) of nozzles 21, 22. In particular, FIG. 3 shows a first velocity curve 301 (illustrated as dashes) of the droplet velocity 134 as a function of the activation frequency or of the line clock rate (for a first group), and a second velocity curve 302 (illustrated as dots) of the droplet velocity 134 as a function of the activation frequency or of the line clock rate (for a second group).

As is clear from FIG. 3, the droplet velocities 134 of the two groups of nozzles 21, 22 deviate significantly from one another, at least for some activation frequencies or line clock rates. Such deviations may be caused by resonance properties of different regions of a print head 103.

It is typically desirable to use an optimally high print speed, and thus an optimally high activation frequency of the nozzles 21, 22, given a defined print quality. A print head 103 typically has a maximum possible activation frequency 304 (from which results a corresponding maximum possible line clock rate for the operation of the printing device 100). An optimized operating activation frequency or an optimized operating line clock rate 303 at which the droplet velocities 134 of the different groups of nozzles 21, 22 deviate as little as possible from one another (on average), and are optimally closely situated at the maximum possible activation frequency or at the maximum possible line clock rate 304, may now be determined on the basis of the velocity data from FIG. 3. The inkjet printing device 100 may then be operated with the optimized operating line clock rate 303 so that the nozzles 21, 22 of the printing device 100 exhibit relatively homogeneous droplet velocities 134 and, as a result of thus, a precise dot positioning is produced (along the transport direction 1).

Figure 2B:
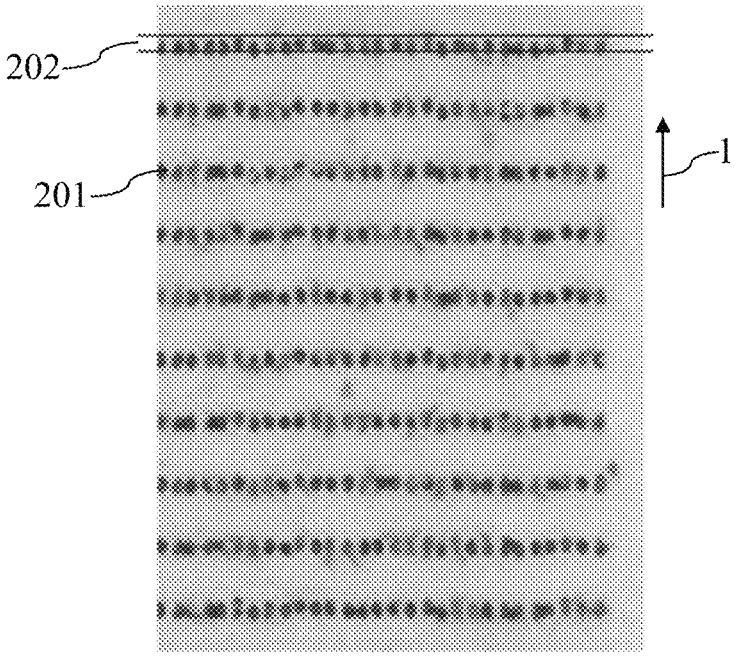

FIG. 2*b* illustrates the printed dots of a line 201 given use of an optimized operating line clock rate 303. From FIG. 2*b*, it is clear that the dot positioning may be significantly improved in comparison to FIG. 2*a* via the use of an optimized operating line clock rate 303.

In an exemplary embodiment, the dependency of the droplet velocity 134 of a nozzle 21, 22 on the activation frequency of the print head 103 (which is also referred to as Drop on Demand (DoD) frequency) is used to reduce (e.g. minimize) the droplet velocity differences between different groups of nozzles 21, 22, in particular between different nozzle rows 111, by changing the activation frequency. A DoD curve or velocity curve 301, 302 may be prepared (see FIG. 3) for each group (in particular for each row 111) of nozzles 21, 22. The different response of the different groups (in particular of the different rows 111) is typically based on the design of a print head 103, and in particular on the fact that different conditions (for example with regard to the supply channels, the structure of the side walls etc.) are present for the different groups. In an exemplary embodiment, the optimized operating activation frequency 303 is determined by evaluating the DoD curves or velocity curves 301, 302. By adapting the nominal activation frequency or the nominal line clock rate of a print head 103 (and possibly via corresponding adaptation of the transport velocity of the recording medium 120), it is thus possible to reduce, in particular to minimize, the differences of the droplet velocities 134 between the different groups.

The DoD curves or velocity curves 301, 302 of the different groups of nozzles 21, 22 may be determined for all print heads 103 of a printing device 100. The optimized operating activation frequency or the optimized operating line clock rate 303 that is used for the nozzles 21, 22 of all print heads 103 may then be determined on the basis of the DoD curves or velocity curves 301, 302 for all print heads 103.

Figure 4:
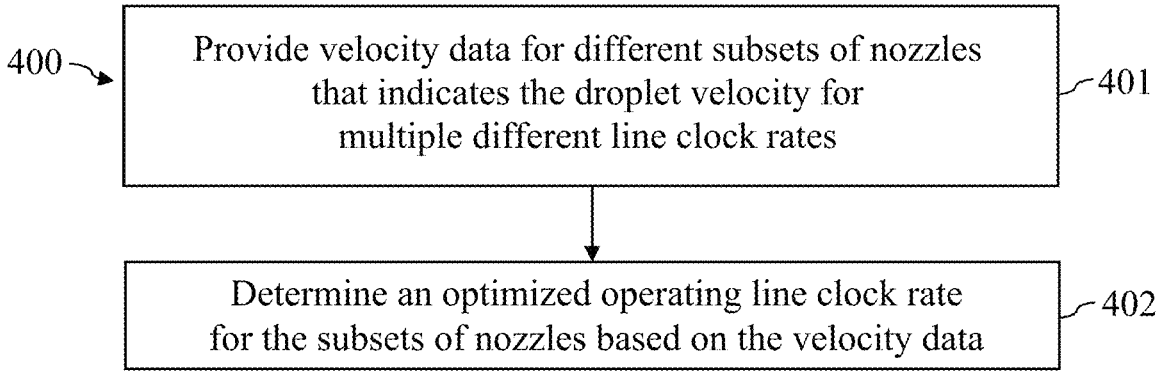
FIG. 4 illustrates a workflow diagram of a method for improving the droplet positioning of nozzles of an inkjet printing device according to an exemplary embodiment of the present disclosure.

FIG. 4 shows a workflow diagram of a method 400 for improving the positioning of ink droplets 131 of an inkjet printing device 100. In an exemplary embodiment, the printing device 100 has a plurality of nozzles 21, 22 for printing to a recording medium 120. In particular, the positioning of ink droplets along the transport direction 1 of a recording medium 120 should be improved via the method 400. In particular, fluctuations of the positioning of ink droplets 131, which fluctuations result along the printing width (transversal to the transport direction 1) due to the use of different nozzles 21, 22, should thereby be reduced. In particular, it should result that the dots printed along a line 201 (transversal to the transport direction 1) are situated within a band transversal to the transport direction 1, which band exhibits an optimally small width along said transport direction 1. As is depicted in conjunction with FIG. 1*b*, this may be achieved in particular in that the actuators of the nozzles 21, 22 of the printing device 100 are operated according to a line clock rate 303 that is selected such that an optimally similar droplet velocity 134 of ejected ink droplets 131 is achieved (for all nozzles 21, 22 of a print head 103, and typically for all print heads 103 of a printing device 100).

In an exemplary embodiment, the method 400 includes the determination and/or the provision and/or the use 401 of velocity data for different subsets of the plurality of nozzles 21, 22. For example, the velocity data may be determined, in particular recorded, during the operation of a printing device 100. In an exemplary embodiment, alternatively or additionally, the velocity data is determined outside of the printing device 100 and be provided to said printing device 100 (for example via a memory of the printing device 100). For different line clock rates for operation of the printing device 100, the velocity data of a subset of nozzles 21, 22 may indicate a respective droplet velocity 134 of ink droplets 131 that have been ejected by the one or more nozzles 21, 22 of the subset. The droplet velocity 134 for a line clock rate may be a mean droplet velocity 134 of the ink droplets 131 ejected by the nozzles 21, 22 of a subset.

In particular, the velocity data of a subset of nozzles 21, 22 may indicate the droplet velocity 134 of ink droplets 131 as a function of the line clock rate. For example, the velocity data may indicate droplet velocity curves 301, 302 (as shown in FIG. 3).

In an exemplary embodiment, to determine the velocity data, the one or more nozzles 21, 22 of a subset of nozzles 21, 22 may be operated according to a defined line clock rate, and the (e.g. mean) droplet velocity 134 of the ejected ink droplets 131 given operation with the defined line clock rate may be determined. The line clock rate may then be varied in order to determine the (e.g. mean) droplet velocity 134 given operation with a different line clock rate. The respective (e.g. mean) droplet velocities 134 may thus be determined for a plurality of different line clock rates.

Moreover, in an exemplary embodiment, the method 400 includes the determination 402 of an (optimized) operating line clock rate 303 for the operation of the inkjet printing device 100 on the basis of the velocity data. The operating line clock rate 303 may thereby be determined in particular such that deviations between the droplet velocities 134 of the different subsets of nozzles 21, 22 are reduced.

In an exemplary embodiment, the determination 402 of the operating line clock rate 303 includes the determination, based on the velocity data, of a value of a distance measurement of the droplet velocities 134 of the different subsets of nozzles 21, 22 for a defined line clock rate. In an exemplary embodiment, the distance measurement includes, for example, a mean quadratic deviation and/or a mean absolute deviation of the droplet velocities 134. In an exemplary embodiment, the operating line clock rate 303 is determined based on the values of the distance measurement for different line clock rates such that the value of the distance measurement is reduced, in particular is minimized. For example, the line clock rate may be iteratively varied as long as the value of the distance measurement can be reduced. The iterative process may be terminated if the value of the distance measurement between the iterations still varies only within a predetermined tolerance range.

In an exemplary embodiment, for the method 400, the droplet velocities 134 of the nozzles 21, 22 of different subsets of the nozzles 21, 22 of an inkjet printing device 100 are determined for different line clock rates. An operating line clock rate 303 for the operation of the printing device 100 may then be determined at which the droplet velocities 134 of the nozzles 21, 22 of the different subsets deviate as little from one another as possible. The droplet positioning along the transport direction 1 of a recording medium 120 to be printed to may be improved or homogenized via the convergence of the droplet velocities 134.

The inkjet printing device 100 may typically be operated only with a maximum possible line clock rate 304. In particular, the one or more print heads 103 of an inkjet printing device 100 may be operated only with a maximum possible line clock rate 304. The operating line clock rate 303 may then be determined such that the operating line clock rate 304 falls below the maximum possible line clock rate 304 by at most 20%, 10%, 5%, 2%, or less. Furthermore, an optimally high print speed of the printing device 100 may thus be ensured.

The plurality of nozzles 21, 22 may be arranged in multiple rows 111 of a print head 103 of the printing device 100. The different subsets of nozzles 21, 22 may respectively comprise the nozzles 21, 22 of one of the rows 111 of the print head 103. In other words, a subset of nozzles 21, 22 may be formed by the nozzles 21, 22 (in particular by all nozzles 21, 22) of a corresponding row 111 of the print head 103. Per design of a nozzle head 103, the nozzles 21, 22 of a nozzle row 111 typically have a relatively uniform droplet velocity 134, whereas the nozzles 21, 22 of different nozzle rows 111 have relative different droplet velocities 134. Via the grouping according to nozzle rows 111, subsets of nozzles 21, 22 may thus be formed that enable an efficient and reliable adaptation of the droplet velocities 134.

A subset of nozzles 21, 22 may possibly include a portion of the nozzles 21, 22 of a row 111 of the print head 103. In other words, a row 111 of a print head 103 may be subdivided into multiple subsets of nozzles 21, 22. The accuracy of an optimal operating line clock rate 303 may thus be further increased.

In an exemplary embodiment, the velocity data is determined using image data of an image sensor, where the image sensor is configured to detect the positioning of ink droplets 131 on a recording medium 120 printed to by the inkjet printing device 100. The droplet velocity 134 of the ink droplet 131 may thereby be determined/concluded from the position 133 of an ink droplet 131 along the transport direction 1 (as presented in conjunction with FIG. 1*b*). The consideration of image data enables the determination of the operating line clock rate 303 within a printing device 100 (for example by means of a sensor 150 of the printing device 100). An adaptation of the line clock rate may thus possibly take place during the printing operation in order to increase the print quality of the printing device 100.

In an exemplary embodiment, alternatively or additionally, the velocity data is determined using sensor data of a velocity sensor that is configured to detect the velocity of an ink droplet 131 in flight, said ink droplet 131 being ejected from a nozzle 21, 22. Velocity data may thus be determined reliably and precisely in advance of the operation of a printing device 100.

Within the printing device 100, a recording medium 120 that is to be printed to by the plurality of nozzles 21, 22 is typically directed along the transport direction 1, past the plurality of nozzles 21, 22. The nozzles 21, 22 thereby eject ink droplets 131 while the recording medium 120 is moving. The ratio of the (operating) line clock rate and the transport velocity is typically constant given a fixed dot resolution in the transport direction 1. A change of the line clock rate consequently typically incurs a corresponding change of the transport velocity of the recording medium 120 (given a fixed dot resolution in the transport direction 1).

In an exemplary embodiment, the inkjet printing device 100 includes a plurality of nozzles 21, 22 (for example in one or more print heads 103), where a nozzle 21, 22 is configured to eject at least one ink droplet 131 to print a dot of a print image onto a recording medium 120. In particular, the actuators of the plurality of nozzles 21, 22 may be activated according to an operating line clock rate 303 to eject ink droplets 131 to print dots of a print image onto a recording medium 120. In an exemplary embodiment, the printing device 100 includes a movement device (e.g. transport belt, etc.) that is configured to direct the recording medium 120 with a transport velocity along a transport direction 1, past the plurality of nozzles 21, 22, during the printing of a print image.

In an exemplary embodiment, the printing device 100 includes a controller 101 that is configured to activate the plurality of nozzles 21, 22 repeatedly according to the operating line clock rate 303 to repeatedly print different dots of the print image onto the recording medium 120, in particular onto different lines 201 of the print image. The operating line clock rate 303 is thereby dependent on (droplet) velocity data for different subsets of the plurality of nozzles 21, 22. For different line clock rates, the velocity data of a subset of nozzles 21, 22 thereby show a respective (mean) droplet velocity 134 of ink droplets 131 that have been ejected by the one or more nozzles 21, 22 of the subset. Alternatively or additionally, the operating line clock rate 303 may have been determined with the method 400 described in this document. A printing device 100 with an increased print quality may thus be provided.

In an exemplary embodiment, as depicted in FIG. 1*a*, the printing device 100 includes a sensor 150 that is configured to determine sensor data with regard to a print image printed onto the recording medium 120 by the plurality of nozzles 21, 22. The sensor 150 may include an image sensor (in particular an image camera), for example. The controller 101 may be configured to determine the velocity data based on the sensor data generated by the sensor 150. Via the use of an internal sensor 150, the operating line clock rate 303 may be directly determined efficiently within a printing device 100.

In an exemplary embodiment, the controller 101 is configured to vary the activation frequency of the plurality of nozzles 21, 22, or the line clock rate for the operation of the printing device 100, within a limited frequency range. The limited frequency range may thereby extend from the maximum possible line clock rate 304 to a value that is 20%, 10%, 5%, 2%, or less below the maximum possible line clock rate 304. The variation of the line clock rate may be produced by changing the transport velocity of the recording medium 120, and/or by changing the dot resolution in the transport direction 1 of the recording medium 120.

Sensor data may then be determined with regard to a print image printed with different line clock rates. The operating line clock rate 303 for the operation of the inkjet printing device 100 may then be determined on the basis of the sensor data, in particular such that the different subsets of nozzles 21, 22 have optimally identical droplet velocities 134 at the operating line clock rate 303. The operating line clock rate 303 may thus possibly be determined during a running printing process in order to provide a consistently high print quality.

Via the measures described in this document, by means of a slight adaptation of the line clock rate or of the transport velocity of a printing device 100, the print quality of said printing device 100 may be significantly increased (in particular with regard to the sharpness of lines and with regard to streaking).

Conclusion

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, other structural electronic hardware, or a combination thereof. A processor includes a microprocessor, a digital signal processor (DSP), central processing unit (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
21, 22 nozzle
31, 32 column (of the print image)
100 printing device (e.g. printer)
101 controller
102 print bar
103 print head
110 nozzle plate
111 row (nozzles)
120 recording medium
131 ink droplet
132 route (nip)
133 position (on recording medium)
134 droplet velocity
140 print group
150 sensor
201 line (of the print image)
202 available region (for a line)
203 print head boundary
301, 302 droplet velocity curve or DoD curve
303 optimized operating line clock rate
304 maximum possible line clock rate
400 method for improving the droplet positioning
401, 402 method operations

The invention claimed is:

1. A method for improving the positioning of ink droplets of an inkjet printing device having a plurality of nozzles configured to print to a recording medium such that droplet velocities of ink droplets that are ejected by the plurality of nozzles depend on a line clock rate for operation of the inkjet printing device, the method comprising:

providing velocity data for different subsets of the plurality of nozzles, wherein, for different line clock rates, the velocity data of a subset of the different subsets of the plurality of nozzles indicates a respective droplet velocity o ink droplets that have been ejected by one or more of the plurality of nozzles of the subset;

determining, based on the velocity data for the different subsets of the plurality of nozzles, respective distance measurement values of the droplet velocities of the different subsets of the plurality of nozzles for the different line clock rates, each of the distance measurement values including a deviation of droplet velocities of the different subsets of the plurality of nozzles for the corresponding line clock rate of the different clock rates; and determining an operating line clock rate for the operation of the inkjet printing device, based on the respective distance measurement values for the plurality of different line clock rates, such that the determined operating line clock rate has a distance measurement value of the distance measurement values whose deviation of droplet velocities is reduced.

2. The method according to claim 1, wherein the deviation of droplet velocities is a mean quadratic deviation of the droplet velocities of the different subsets of the plurality of nozzles for the respective line clock rate of the different clock rates.

3. The method according to claim 1, wherein:

the inkjet printing device is configurable to be operated with a maximum possible line clock rate; and the operating line clock rate is determined such that the operating line clock rate is less than the maximum possible line clock rate by at most 20%.

4. The method according to claim 1, wherein:

the plurality of nozzles is arranged in multiple rows of a print head; and the different subsets of nozzles respectively comprise the nozzles of one of the rows of the print head.

5. The method according to claim 1, wherein the velocity data of a subset of the plurality of nozzles is indicative of a droplet velocity of ink droplets as a function of the line clock rate.

6. The method according to claim 1, wherein the velocity data is determined based on image data from an image sensor configured to detect the positioning of the ink droplets on the recording medium printed to by the inkjet printing device.

7. The method according to claim 6, wherein the velocity data is further determined based on sensor data from a velocity sensor configured to detect a velocity of an ink droplet that has been ejected by a nozzle of the plurality of nozzles.

8. The method according to claim 1, wherein the velocity data is further determined based on sensor data from a velocity sensor configured to detect a velocity of an ink droplet that has been ejected by a nozzle of the plurality of nozzles.

9. The method according to claim 1, further comprising:

within the printing device, directing the recording medium to be printed to by the plurality of nozzles along a transport direction past the plurality of nozzles with a transport velocity, wherein a ratio of the line clock rate and the transport velocity is constant given a fixed dot resolution in the transport direction of a print image printed onto the recording medium.

10. A non-transitory computer-readable storage medium with an executable program stored thereon, wherein, when executed, the program instructs a processor to perform the method of claim 1.

11. The method according to claim 1, wherein determining the operating line clock rate for the operation of the inkjet printing device comprises determining the operating line clock rate whose distance measurement value includes a minimal deviation of droplet velocities.

12. An inkjet printing device configured to print to a recording medium, comprising:

a plurality of nozzles respectively having at least one actuator, wherein the actuators of the plurality of nozzles are configured to be activated based on an operating line clock rate to eject ink droplets to print dots of a print image onto the recording medium with respective droplet velocities that depend on the line clock rate;

a transport configured to direct the recording medium along a transport direction with a transport velocity past the plurality of nozzles during the printing of the print image; and a controller configured to repeatedly activate the actuators of the plurality of nozzles based on the operating line clock rate to repeatedly print different dots of the print image onto the recording medium, the operating line clock rate being dependent on velocity data for different subsets of the plurality of nozzles, wherein the velocity data of a subset of the different subsets of the plurality of nozzles for different line clock rates respectively indicates a droplet velocity of ink droplets that have been ejected by one or more nozzles of the subset of the plurality of nozzles, the operating line clock rate being determined such that a distance measurement value defining a deviation of the droplet velocities of the different subsets of nozzles for the different line clock rates is reduced, wherein the distance measurement value is dependent on the velocity data.

13. The inkjet printing device according to claim 12, further comprising:

a sensor configured to determine sensor data corresponding to a print image printed onto the recording medium by the plurality of nozzles, wherein the controller is configured to determine the velocity data based on the sensor data from the sensor.

14. The inkjet printing device according to claim 12, further comprising:

an image sensor configured to detect position information of the ink droplets printed on the recording medium, wherein the controller is configured to determine the velocity data based on the position information.

15. The inkjet printing device according to claim 12, wherein the controller is further configured to:

determine sensor data with regard to the print image printed with different line clock rates; and determine the operating line clock rate for the operation of the inkjet printing device based on the sensor data such that the different subsets of nozzles of the plurality of nozzles have optimally identical droplet velocities at the operating line clock rate.

16. The inkjet printing device according to claim 15, wherein the controller is further configured to vary the line clock rate for operation of the inkjet printing device within a limited frequency range.

* * * * *